US012716308B2

(12) United States Patent
Frost et al.

(10) Patent No.: US 12,716,308 B2
(45) Date of Patent: Aug. 25, 2026

(54) EXTENDED CHEMICAL TREATMENT IN SUBTERRANEAN WELLS

(71) Applicant: ODESSA SEPARATOR, INC.

(72) Inventors: Cavin Bert Frost, Odessa, TX (US); Daniel L. Culbertson, Odessa, TX (US); Gustavo A. Gonzalez-Cabrera, Midland, TX (US); Jonathan F. Yates, Odessa, TX (US); Luis A. Guanacas, Midland, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 0 days.

(21) Appl. No.: 19/051,283

(22) Filed: Feb. 12, 2025

(65) Prior Publication Data

US 2025/0263993 A1 Aug. 21, 2025

Related U.S. Application Data

(60) Provisional application No. 63/555,633, filed on Feb. 20, 2024.

(51) Int. Cl.

| | |
|---|---|
| ***E21B 23/08*** | (2006.01) |
| ***E21B 34/06*** | (2006.01) |
| ***E21B 37/06*** | (2006.01) |
| ***E21B 43/08*** | (2006.01) |

(52) U.S. Cl.

CPC ..... *E21B 23/08* (2013.01); *E21B 34/063* (2013.01); *E21B 37/06* (2013.01); *E21B 43/08* (2013.01)

(58) Field of Classification Search

CPC ..... E21B 23/08; E21B 34/063; E21B 37/06; E21B 43/08; E21B 43/25

See application file for complete search history.

(56) References Cited

U.S. PATENT DOCUMENTS

| | | | |
|---|---|---|---|
| 2,437,475 | A | 3/1948 | Oxford, Jr. |
| 4,032,457 | A | 6/1977 | Matchett |
| 4,291,763 | A | 9/1981 | Singer |
| 5,114,540 | A | 5/1992 | Law |
| 5,893,416 | A | 4/1999 | Read |
| 7,195,070 | B2 | 3/2007 | Delaloye |
| 7,406,887 | B2 | 8/2008 | Jensen |
| 7,413,009 | B2 | 8/2008 | Jacobs et al. |
| 7,493,955 | B2 | 2/2009 | Gupta et al. |

(Continued)

*Primary Examiner* — Steven A Macdonald
(74) *Attorney, Agent, or Firm* — Smith IP Services, P.C.

(57) ABSTRACT

A method of chemically treating a subterranean well can include connecting chemical treatment tools to each other, each of the chemical treatment tools including a respective chemical treatment, and deploying the treatment tools in the well, thereby contacting one chemical treatment with fluids in the well, while the other chemical treatment(s) remain isolated from the fluids in the well. A chemical treatment system can include multiple chemical treatment tools connected together, with a fluid passage extending between interiors of the chemical treatment tools, chemical treatments disposed in the respective interiors of the chemical treatment tools, and a fluid barrier blocking fluid flow through the fluid passage. A method of well tool actuation can include connecting well tools to each other with a fluid barrier, deploying the well tools into the well, and opening the fluid barrier, thereby actuating one of the well tools.

13 Claims, 4 Drawing Sheets

(56) References Cited

U.S. PATENT DOCUMENTS

| | | | | |
|---|---|---|---|---|
| 7,503,389 | B2 | 3/2009 | Delaloye et al. | |
| 7,994,103 | B2 | 8/2011 | Campbell et al. | |
| 8,596,366 | B2 | 12/2013 | Franklin et al. | |
| 8,820,416 | B2 * | 9/2014 | Holderman | E21B 34/06 166/373 |
| 8,950,491 | B2 * | 2/2015 | Frost | E21B 37/06 166/310 |
| 9,097,093 | B1 * | 8/2015 | Frost | E21B 37/06 |
| 9,187,991 | B2 | 11/2015 | Fripp et al. | |
| 9,428,989 | B2 | 8/2016 | Aitken et al. | |
| 10,837,260 | B2 * | 11/2020 | McClean | E21B 17/18 |
| 10,844,680 | B2 * | 11/2020 | Ross | E21B 27/02 |
| 11,454,090 | B2 * | 9/2022 | Gonzalez-Cabrera | E21B 34/12 |
| 11,725,477 | B2 * | 8/2023 | Frost | B01D 29/15 166/205 |
| 12,312,916 | B1 * | 5/2025 | von Gynz-Rekowski | E21B 33/12 |
| 12,378,835 | B2 * | 8/2025 | Wang | E21B 27/02 |
| 12,410,687 | B2 * | 9/2025 | Alsunnary | E21B 37/06 |
| 2004/0084186 | A1 | 5/2004 | Allison | |
| 2006/0011345 | A1 | 1/2006 | Delaloye et al. | |
| 2008/0023703 | A1 | 1/2008 | Hoffman et al. | |
| 2009/0288838 | A1 | 11/2009 | Richards | |
| 2011/0162841 | A1 | 7/2011 | Wilson | |
| 2012/0012326 | A1 | 1/2012 | Darby et al. | |
| 2012/0061072 | A1 * | 3/2012 | Streich | E21B 27/02 166/75.15 |
| 2012/0085540 | A1 * | 4/2012 | Heijnen | E21B 43/26 166/305.1 |
| 2012/0285695 | A1 * | 11/2012 | Lafferty | C09K 8/03 166/310 |
| 2013/0327528 | A1 * | 12/2013 | Frost | E21B 37/06 166/310 |
| 2017/0259977 | A1 * | 9/2017 | Hall | E21B 43/2607 |
| 2019/0128081 | A1 * | 5/2019 | Ross | E21B 34/066 |
| 2020/0102811 | A1 * | 4/2020 | McClean | C09K 8/524 |
| 2020/0248532 | A1 * | 8/2020 | Gonzalez-Cabrera | E21B 34/12 |
| 2021/0025260 | A1 * | 1/2021 | Frost | B01D 35/02 |
| 2025/0075577 | A1 * | 3/2025 | Wang | E21B 41/02 |

* cited by examiner

EXTENDED CHEMICAL TREATMENT IN SUBTERRANEAN WELLS

CROSS-REFERENCE TO RELATED APPLICATION

This application claims the benefit of the filing date of U.S. provisional application No. 63/555,633 filed on 20 Feb. 2024. The entire disclosure of the prior application is incorporated herein by this reference for all purposes.

BACKGROUND

This disclosure relates generally to equipment utilized and operations performed in conjunction with a subterranean well and, in an example described below, more particularly provides for extended chemical treatment in wells.

Chemical treatments may be used in wells for a variety of different purposes and combinations of purposes. For example, a particular chemical treatment may be useful for preventing paraffin accumulation in a producing wellbore, and another chemical treatment may be useful for preventing corrosion of tubulars in a producing or injection wellbore.

It will, therefore, be appreciated that improvements are continually needed in the art of designing, constructing and utilizing chemical treatment tools and other types of tools for use in wells. The present disclosure provides such improvements, which may be used in a wide variety of different well configurations and well operations.

DETAILED DESCRIPTION

Figure 1:
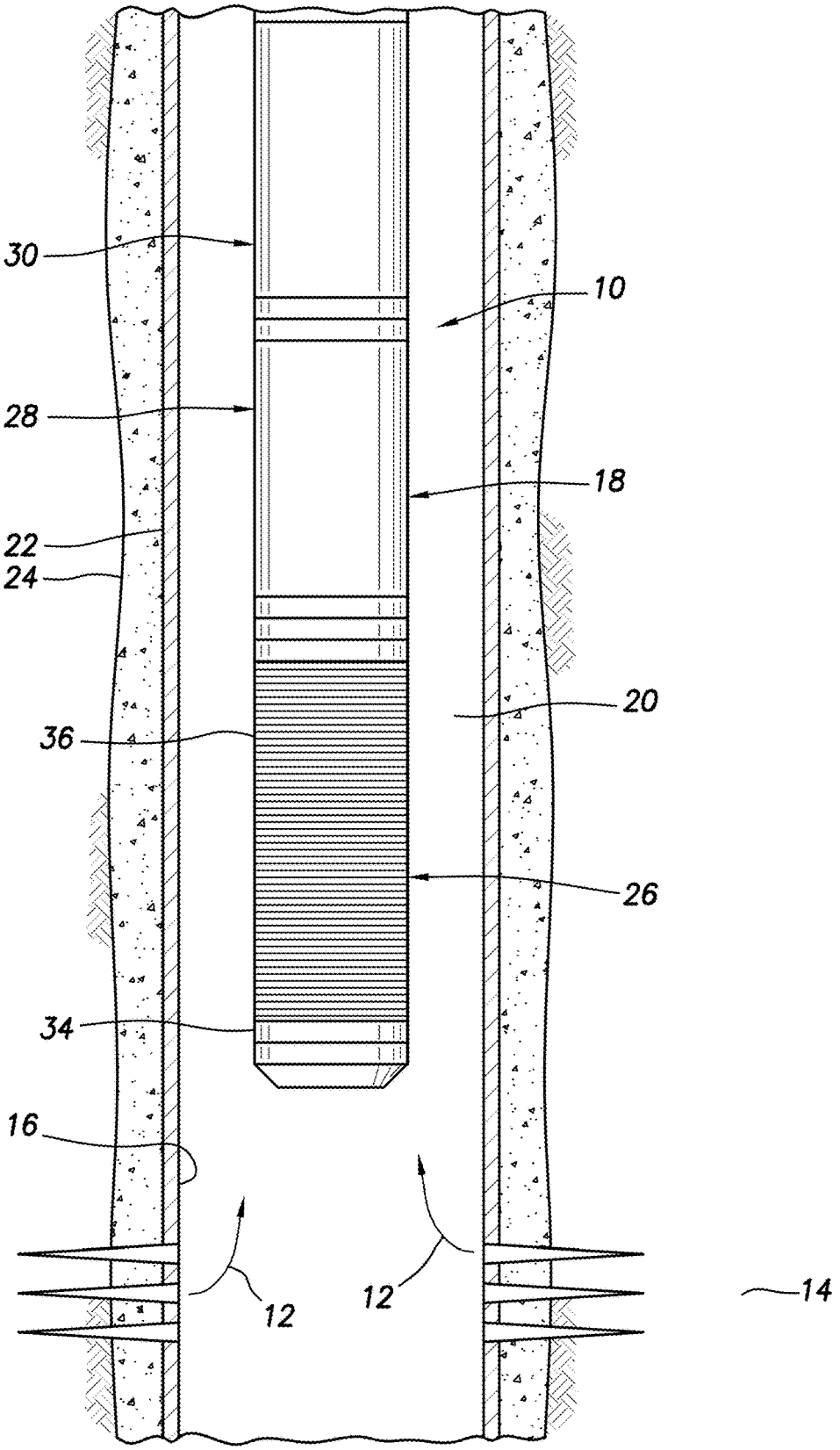
FIG. 1 is a representative partially cross-sectional view of an example of a well system and associated method which can embody principles of this disclosure.

Representatively illustrated in the accompanying drawings are a system and associated method which can embody principles of this disclosure. However, it should be clearly understood that the system and method are merely one example of an application of the principles of this disclosure in practice, and a wide variety of other examples are possible. Therefore, the scope of this disclosure is not limited at all to the details of the system and method described herein and/or depicted in the drawings.

The system includes an extended chemical treatment tool that, in one example, delivers a steady chemical treatment where it is most needed and effective—at or near a bottom of a wellbore. The tool in this example delivers a solid stick chemical blend that is tailored to counteract specific conditions unique to particular wellbore applications.

Depending on well conditions, chemical treatment may last for several months. When the chemical blend is depleted, treatment tapers off and eventually stops. Without access to additional solid stick chemical blend, the options are limited, for example, to cease treatment or pull the well completion and replace the tool.

Solid stick chemical blend within the tool described herein makes contact with wellbore fluid and begins to liquify, providing chemical treatment. Dispersion of chemical blend into the wellbore fluid occurs through perforations in the tool assembly.

Vee-wire (or other type) screen regulates the rate of dispersion. The use of a rupture disc or other openable barrier allows for extended treatment time. Solid stick chemical blend is isolated and contained within one or more tool isolated sections until access to the isolated section(s) is activated.

When the operator determines there is a need to introduce additional chemical blend to the wellbore, casing pressure is increased, forcing fluid through perforations in the tool, until the rupture disc bursts or the barrier is otherwise opened. This allows for well fluid to contact the chemical blend material stored within the tool isolated section and begin treatment again.

In another example, the rupture disc or other barrier may be used to actuate or activate other types of well tools, such as sand control tools.

A tool, system and method for extending a chemical treatment in a subterranean well is described herein, in which a second chemical treatment is exposed to well fluid after a first chemical treatment is exposed to the well fluid.

A barrier is opened to expose the second chemical treatment to the well fluid. The barrier may comprise a rupture disc.

The barrier may be opened by increasing pressure in the well. The pressure may be increased in an annulus between the tool and a wellbore of the well.

The second chemical treatment may be positioned in a tubular housing connected above a screen that filters fluid communication between an interior of the tubular housing and an annulus between the tool and a wellbore of the well.

Also described herein is a tool, system and method, in which rupturing a rupture disc or otherwise opening a barrier is used to activate or actuate another well tool.

Referring specifically now to FIG. 1, a partially cross-sectional view of an example of a system 10 for chemically treating a well (or fluids 12 in the well) is representatively illustrated. In this example, the fluids 12 are at least in part produced from an earth formation 14 surrounding a wellbore 16 of the well. In other examples, the fluids 12 may comprise fluids flowed into the well (such as, from the surface via a tubular string or an annulus formed between the tubular string and the wellbore) or other fluids present in the wellbore 16.

As depicted in FIG. 1, a tubular string 18 has been deployed into the wellbore 16. An annulus 20 is formed radially between an exterior surface of the tubular string 18 and the wellbore 16. In this example the wellbore 16 is lined with casing 22 and cement 24, but in other examples, the tubular string 18 could extend into an uncased or open hole section of the wellbore.

The tubular string 18 in this example includes multiple chemical treatment tools 26, 28, 30 connected together. The tool 30 may be the same as or similar to the tool 28. Any number, type or combination of tools may be used in the tubular string 18, in keeping with the scope of this disclosure.

A chemical treatment 32 (see FIG. 2) is disposed in a respective interior of each of the well tools 26, 28, 30. The chemical treatment 32 in the tool 26 is exposed to and contacted with the well fluids 12 immediately when the tubular string 18 is deployed into the wellbore 16.

In this example, this fluid contact is due to the tool 26 including an outer housing 34 that is perforated and provided with a screen 36 that filters fluid flow between the interior and an exterior of the outer housing (the annulus 20 in the FIG. 1 example). In contrast, the tools 28, 30 include outer housings 38 that are not perforated and do not permit fluid communication between their interiors and exteriors.

The interiors of the tools 28, 30 are isolated from the wellbore 16, so the chemical treatments 32 therein are not exposed to or contacted with the well fluids 12, when the tubular string 18 is deployed into the well. Instead, the chemical treatments 32 in the interiors of the tools 28, 30 are exposed to or contacted with the well fluids 12 only after the tubular string 18 is deployed into the well and the chemical treatment in the tool 26 has been exposed to or contacted with the well fluids.

In this manner, a duration of chemical well treatment deployment is extended. The extended duration results from exposing the chemical treatments 32 in the different respective tools 26, 28, 30 to the well fluids 12 in series (one after another), rather than in parallel (at the same time).

However, note that the chemical treatments 32 in two or more of the tools 26, 28, 30 may be simultaneously exposed to or contacted with the well fluids 12 in keeping with the scope of this disclosure. For example, the chemical treatment 32 in the tool 28 may be exposed to or contacted with the well fluids 12 after the chemical treatment in the tool 26 is exposed to or contacted with the well fluids, but before the chemical treatment in the tool 26 is completely dissolved or dispersed.

Figure 2:
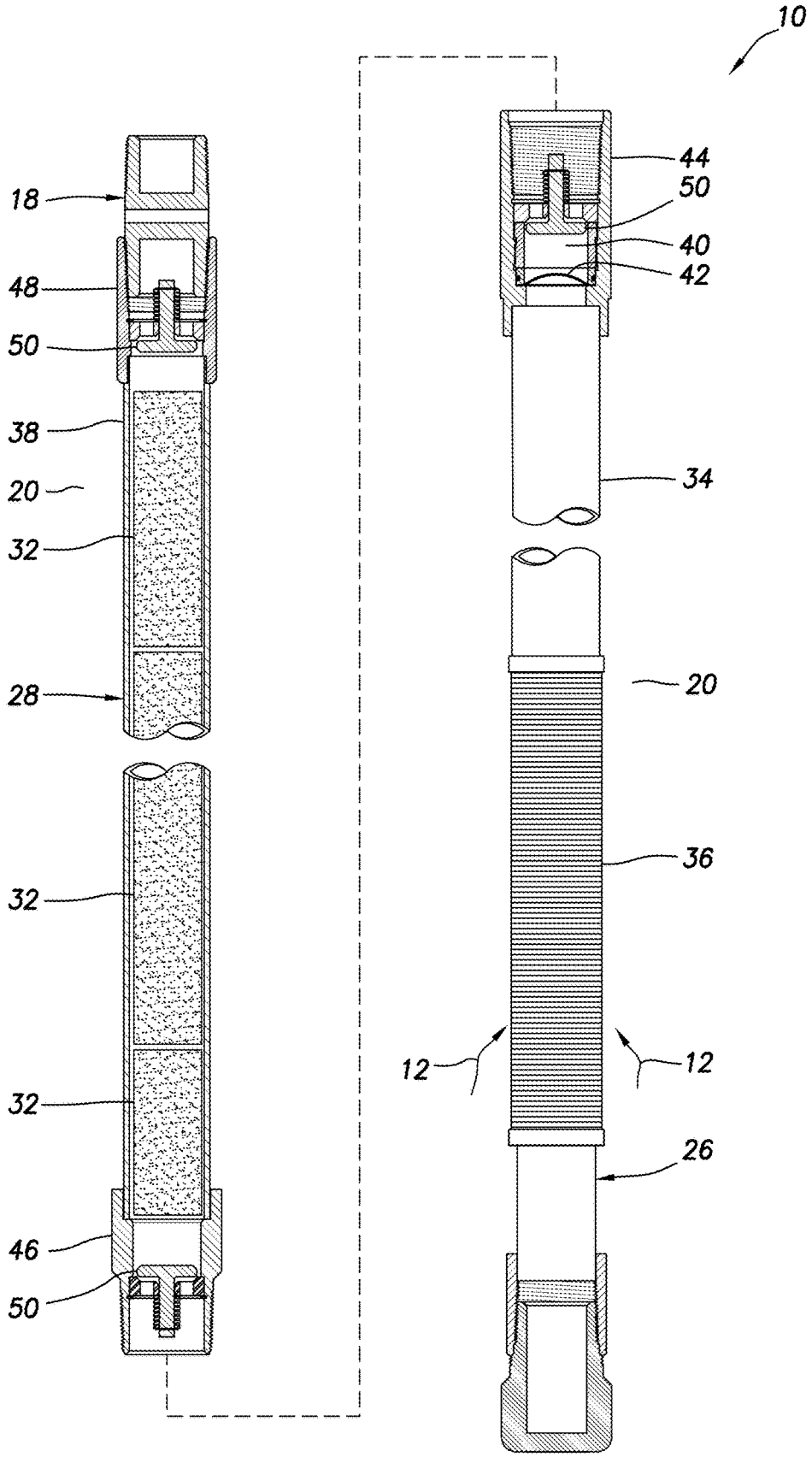
FIG. 2 is a representative partially cross-sectional view of an example of a chemical treatment tool that may be used with the FIG. 1 system and method, and which can embody the principles of this disclosure.

Referring additionally now to FIG. 2, a partially cross-sectional view of examples of the chemical treatment tools 26, 28 connected together in the tubular string 18 is representatively illustrated. Any number of each of the tools 26, 28 may be used in the tubular string 18. For convenience, the FIG. 2 tubular string 18 is described below as it may be used with the FIG. 1 system 10 and method, but the FIG. 2 tubular string 18 may be used with other systems and methods in keeping with the scope of this disclosure.

As depicted in FIG. 2, multiple chemical treatments 32 are contained in the outer housing 38 of the tool 28. The chemical treatments 32 are isolated from an exterior of the tool 28. Thus, when the tubular string 18 is deployed into the wellbore 16, the chemical treatments 32 are not contacted with or exposed to the well fluids 12.

One or more chemical treatments 32 are also contained in the outer housing 34 of the tool 26. However, the outer housing 34 is perforated or otherwise permits fluid communication between the interior and exterior of the outer housing. Thus, when the tubular string 18 is deployed into the wellbore 16, the chemical treatment 32 in the tool 26 is contacted with or exposed to the well fluids 12.

A fluid passage 40 extends between the interior of the outer housing 34 and the interior of the outer housing 38. Initially, fluid flow through the fluid passage 40 is prevented or blocked by a fluid barrier 42. In this example, the fluid barrier 42 is in the form of a rupture disc 42 positioned in a coupler 44 configured to connect the tools 26, 28 to each other. However, other types of fluid barriers (such as, valves, diaphragms, plugs, etc.) and other positions of the fluid barrier may be used in other examples.

In the FIG. 2 example, the tools 26, 28 are connected to each other (and to additional tools 30 in other examples) with couplers 44, 46, 48 comprising check valves or pressure containment valves 50. The valves 50 are opened when the couplers 44, 46 are appropriately connected to each other. Suitable couplers and valves are described in U.S. Pat. No. 11,454,090, the entire disclosure of which is incorporated herein by this reference for all purposes.

When it is desired to expose the chemical treatment(s) 32 in the tool 28 to the well fluids 12, a sufficient pressure differential is applied across the barrier 42 to cause the barrier to be opened. In the FIG. 2 example, the pressure differential is from the interior of the tool 26 (or the exterior of the tool 26, since the interior and exterior are in fluid communication) to the interior of the tool 28.

For example, increased pressure may be applied to the annulus 20 on the exterior of the tool 26, which will also be communicated via the housing 34 and screen 36 to the interior of the tool 26. In this manner the pressure differential is created across the barrier 42 sufficient to cause the barrier to be opened. In the FIG. 2 example, the pressure differential corresponds to the pressure differential across the rupture disc that is sufficient to cause the rupture disc to rupture. When the rupture disc is ruptured, fluid communication will be permitted between the interiors of the tools 26, 28, and the chemical treatments 32 in the tool 28 will be exposed to or contacted with the well fluids 12.

Figure 3:
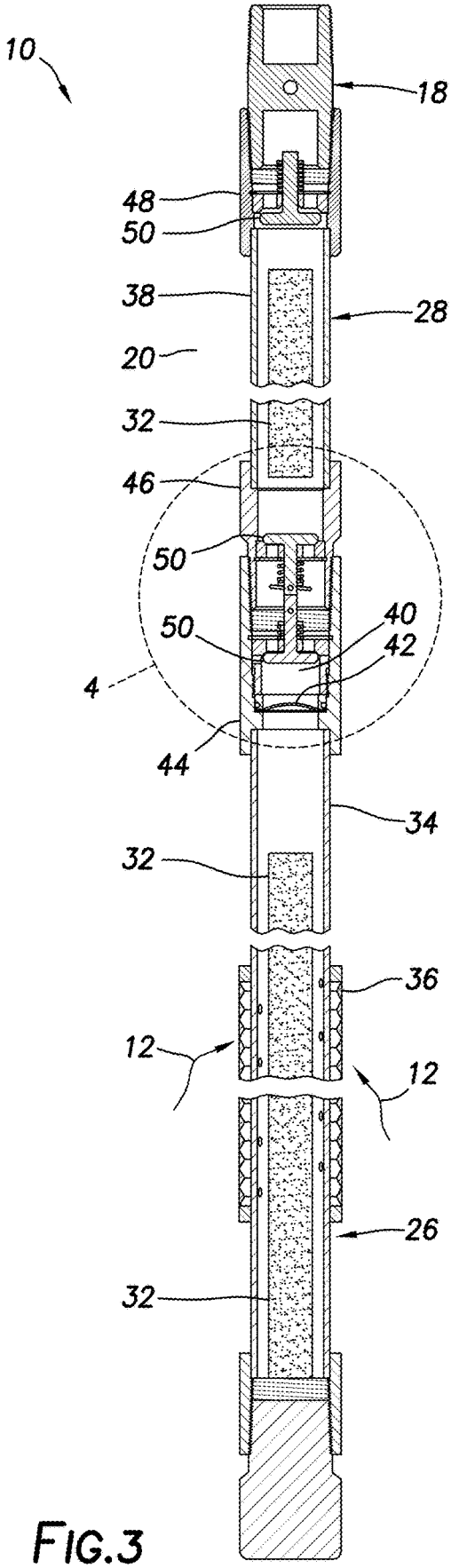
FIG. 3 is a representative cross-sectional view of another example of the chemical treatment tool in a run-in configuration.

Referring additionally now to FIG. 3, a partially cross-sectional view of another example of the tubular string 18 is representatively illustrated. In this view, the couplers 44, 46 are connected to each other, thereby connecting the tools 26, 28.

Figure 4:
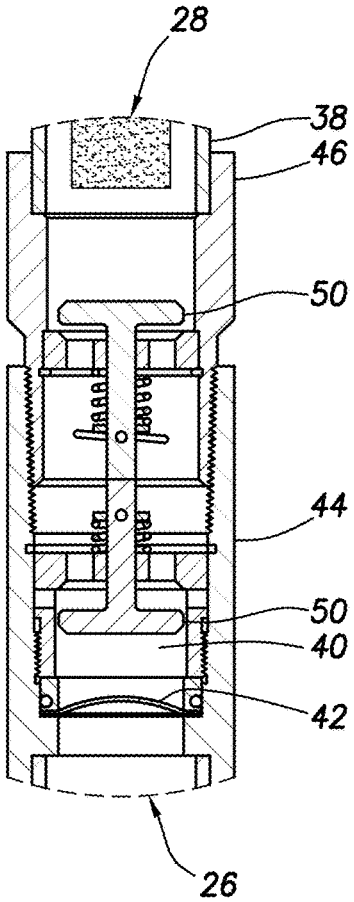
FIG. 4 is a representative cross-sectional view of a check valve mechanism of the chemical treatment tool, comprising detail '4' of FIG. 3.

In FIG. 4, the manner in which the valves 50 in the couplers 44, 46 are opened when the couplers are connected to each other can be seen. Thus, when the tools 26, 28 are connected to each other, the interior of the tool 26 can communicate with the interior of the tool 28 if the barrier 42 is opened (e.g., by applying sufficient pressure in the interior of the tool 26 to cause the barrier to open or rupture).

Figure 5:
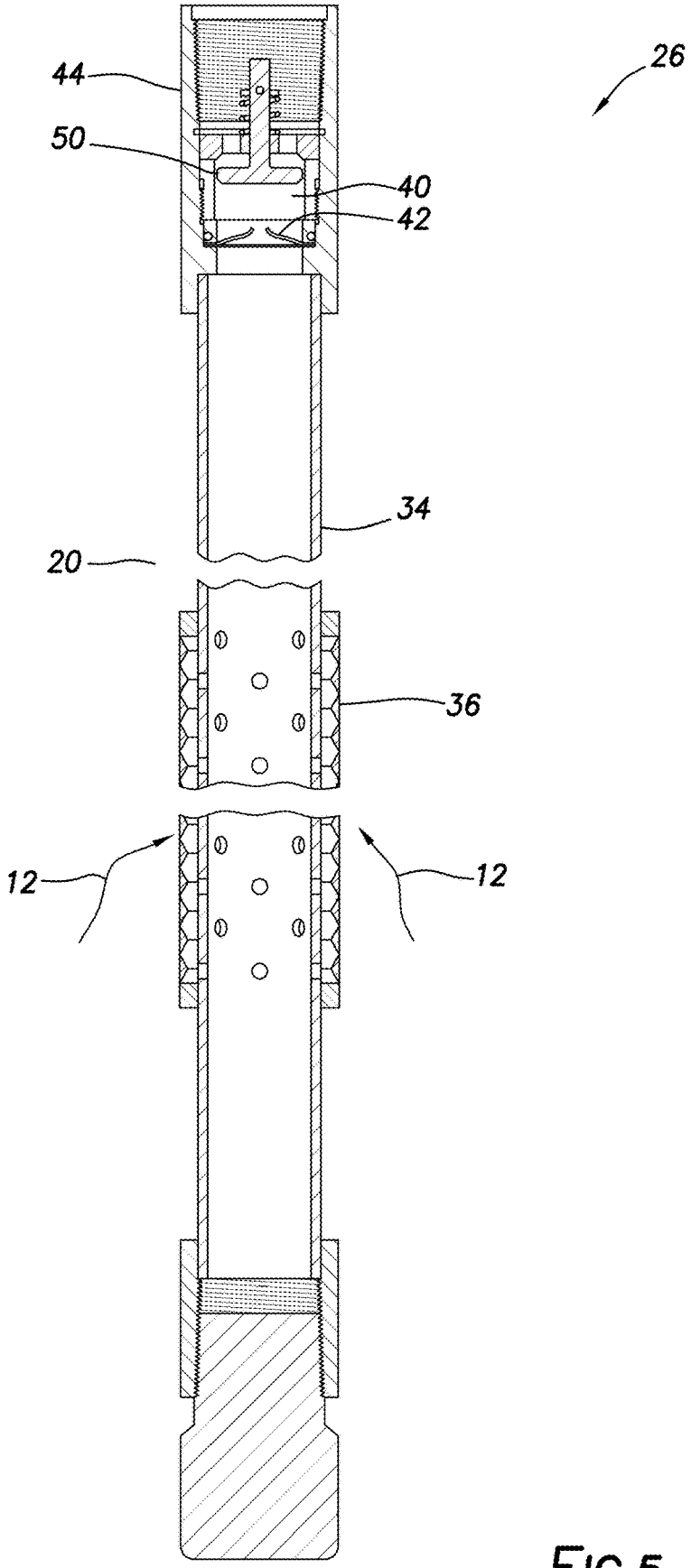
FIG. 5 is a representative cross-sectional view of a screen section of the chemical treatment tool in an actuated configuration.

Referring additionally now to FIG. 5, a cross-sectional view of an example of the chemical treatment tool 26 in an actuated configuration is representatively illustrated. In this view, the chemical treatment 32 in the interior of the housing 34 is completely or substantially dissolved or dispersed.

The fluid barrier 42 has been opened by application of increased pressure to the exterior (e.g., the annulus 20) and interior of the tool 26. The resulting pressure differential across the barrier 42 has caused the barrier to rupture in this example, thereby permitting fluid communication through the fluid passage 40 between the interiors of the tools 26, 28.

Thus, the well fluids 12 contact the chemical treatment 32 in the tool 28 when the barrier 42 is opened. The dissolved or dispersed chemical treatment 32 due to the well fluids 12 contacting the chemical treatment in the tool 28 can be communicated to the wellbore 16 or annulus 20 via the open fluid passage 40, the open fluid barrier 42, the interior of the housing 34 and the screen 36.

Note that the chemical treatment tools 26, 28, 30 are merely examples of types of well tools that can be actuated using the features of the invention as disclosed herein. In other examples, the tools 26, 28, 30 could be other types of well tools, such as, sand control equipment, completion equipment, fluid separation equipment, etc.

It may now be fully appreciated that the above disclosure provides significant improvements to the art of designing, constructing and utilizing chemical treatment tools and other types of tools for use in wells. In examples described above, multiple chemical treatment tools 26, 28 can be deployed into a well, with at least one of the tools 26 having a chemical treatment 32 that is exposed to well fluids 12, and at least one other tool 28 having a chemical treatment that is not exposed to the well fluids. The second chemical treatment 32 can be exposed to the well fluids 12 a selectable delay after the tools 26, 28 are deployed in the well (such as, when the chemical treatment has completely or substantially dissolved or dispersed).

The above disclosure provides to the art a method of chemically treating a subterranean well. In one example, the method can comprise: connecting at least a first chemical treatment tool 26 to a second chemical treatment tool 28, the first chemical treatment tool 26 including a first chemical treatment 32, and the second chemical treatment tool 28 comprising a second chemical treatment 32; and deploying the first and second chemical treatment tools 26, 28 in the well, thereby contacting the first chemical treatment 32 with fluids 12 in the well, while the second chemical treatment 32 remains isolated from the fluids 12 in the well.

The method may include contacting the second chemical treatment 32 with the fluids 12 in the well only after the first chemical treatment 32 is in contact with the fluids 12 in the well. The step of contacting the second chemical treatment may include opening a fluid barrier 42 between the first and second chemical treatments 32. The opening step may include applying increased pressure to the fluid barrier 42 in the well.

The step of contacting the second chemical treatment 32 may include opening a rupture disc. The step of contacting the second chemical treatment 32 may include opening a fluid passage 40 extending between an interior of a first outer housing 34 of the first chemical treatment tool 26 and an interior of a second outer housing 38 of the second chemical treatment tool 28.

The fluids 12 in the well may also be in the interior of the first outer housing 34 after the deploying step and prior to the opening step. The interior of the second outer housing 38 may be isolated from the fluids 12 in the well after the deploying step and prior to the opening step.

The fluids 12 in the well may also be in the interior of the first outer housing 34 after the deploying step and after the opening step. The fluids 12 in the well may also be in the interior of the second outer housing 38 after the deploying step and after the opening step.

The above disclosure also provides to the art a chemical treatment system 10 for use with a subterranean well. In one example, the system 10 can comprise: at least first and second chemical treatment tools 26, 28 connected together, with a fluid passage 40 extending between interiors of the first and second chemical treatment tools 26, 28; at least first and second chemical treatments 32 disposed in the respective interiors of the first and second chemical treatment tools 26, 28; and a fluid barrier 42 blocking fluid flow through the fluid passage 40.

The fluid barrier 42 may comprise a rupture disc.

The interior of the first chemical treatment tool 26 may be in fluid communication with an exterior of the first chemical treatment tool 26. The interior of the second chemical treatment tool 28 may be isolated from an exterior of the second chemical treatment tool 28.

The first chemical treatment 32 may be disposed in an outer housing 34 of the first chemical treatment tool 26. The outer housing 34 may be perforated.

The outer housing 34 may comprise a screen 36 configured to filter fluid 12 flow between the interior and an exterior of the outer housing 34. The exterior of the outer housing 34 may comprise an annulus 20 formed between the outer housing 34 and a wellbore 16 of the well.

A method of well tool actuation in a subterranean well is also described above. in one example, the method can comprise: connecting at least first and second well tools 26, 28 to each other, at least one of the well tools 26, 28 comprising a fluid barrier 42; deploying the first and second well tools 26, 28 into the well; and opening the fluid barrier 42, thereby actuating the second well tool 28.

The fluid barrier 42 may comprise a rupture disc. The opening step may include increasing fluid pressure in the well.

The actuating step may include admitting fluids 12 in the well to flow into an interior of the second well tool 28. The fluid barrier 42 may block fluid flow through a fluid passage 40 extending between interiors of the first and second well tools 26, 28.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of chemically treating a subterranean well, the method comprising:

connecting at least a first chemical treatment tool to a second chemical treatment tool, the first chemical treatment tool including a first chemical treatment, and the second chemical treatment tool comprising a second chemical treatment;

deploying the first and second chemical treatment tools in the well, thereby contacting the first chemical treatment with fluids in the well, while the second chemical treatment remains isolated from the fluids in the well; and contacting the second chemical treatment with the fluids in the well only after the first chemical treatment is in contact with the fluids in the well, in which the contacting the second chemical treatment comprises opening a fluid passage extending between an interior of a first outer housing of the first chemical treatment tool and an interior of a second outer housing of the second chemical treatment tool.

2. The method of claim 1, in which the contacting the second chemical treatment comprises opening a fluid barrier between the first and second chemical treatments.

3. The method of claim 2, in which the opening comprises applying increased pressure to the fluid barrier in the well.

4. The method of claim 1, in which the contacting the second chemical treatment comprises opening a rupture disc.

5. The method of claim 1, in which the fluids in the well are also in the interior of the first outer housing after the deploying and prior to the opening, and in which the interior of the second outer housing is isolated from the fluids in the well after the deploying and prior to the opening.

6. The method of claim 5, in which the fluids in the well are also in the interior of the first outer housing after the deploying and after the opening, and in which the fluids in the well are also in the interior of the second outer housing after the deploying and after the opening.

7. A chemical treatment system for use with a subterranean well, the system comprising:

at least first and second chemical treatment tools connected together, with a fluid passage extending between interiors of the first and second chemical treatment tools;

at least first and second chemical treatments disposed in the respective interiors of the first and second chemical treatment tools; and a fluid barrier blocking fluid flow through the fluid passage, in which the fluid barrier is opened by increasing fluid pressure in the well.

8. The system of claim 7, in which the fluid barrier comprises a rupture disc.

9. The system of claim 7, in which the interior of the first chemical treatment tool is in fluid communication with an exterior of the first chemical treatment tool.

10. The system of claim 9, in which the interior of the second chemical treatment tool is isolated from an exterior of the second chemical treatment tool.

11. The system of claim 7, in which the first chemical treatment is disposed in an outer housing of the first chemical treatment tool, and in which the outer housing is perforated.

12. The system of claim 7, in which the first chemical treatment is disposed in an outer housing of the first chemical treatment tool, and in which the outer housing comprises a screen configured to filter fluid flow between the interior and an exterior of the outer housing.

13. The system of claim 12, in which the exterior of the outer housing comprises an annulus formed between the outer housing and a wellbore of the well.

* * * * *